US010781019B2

(12) United States Patent
Morris, Jr. et al.

(10) Patent No.: US 10,781,019 B2
(45) Date of Patent: Sep. 22, 2020

(54) CHILD RESISTANT PAIL

(71) Applicants: Glenn H. Morris, Jr., Chattanooga, TN (US); Darrell Davis, Chattanooga, TN (US)

(72) Inventors: Glenn H. Morris, Jr., Chattanooga, TN (US); Darrell Davis, Chattanooga, TN (US)

(73) Assignee: M & M Industries, Inc., Chattanooga, TN (US)

( * ) Notice: Subject to any disclaimer, the term of this patent is extended or adjusted under 35 U.S.C. 154(b) by 12 days.

(21) Appl. No.: 16/266,215

(22) Filed: Feb. 4, 2019

(65) Prior Publication Data

US 2019/0276206 A1 Sep. 12, 2019

Related U.S. Application Data

(60) Provisional application No. 62/640,698, filed on Mar. 9, 2018.

(51) Int. Cl.

| | |
|---|---|
| ***B65D 43/16*** | (2006.01) |
| ***B65D 45/16*** | (2006.01) |
| ***B65D 50/06*** | (2006.01) |
| ***B65D 55/06*** | (2006.01) |
| *B65D 43/22* | (2006.01) |

(52) U.S. Cl.

CPC ..... *B65D 50/067* (2013.01); *B65D 43/16* (2013.01); *B65D 50/06* (2013.01); *B65D 55/06* (2013.01); *B65D 2401/25* (2020.05)

(58) Field of Classification Search

CPC ..... B65D 51/067; B65D 43/16; B65D 50/06; B65D 55/06; B65D 2101/0038

USPC ..... 220/315, 324, 326

See application file for complete search history.

(56) References Cited

U.S. PATENT DOCUMENTS

| | | | | | |
|---|---|---|---|---|---|
| 3,840,152 | A * | 10/1974 | Hodge | B65D 21/022 | 220/783 |
| 5,551,589 | A * | 9/1996 | Nakamura | E05C 19/066 | 220/326 |
| 5,979,691 | A * | 11/1999 | Von Holdt | B65D 43/0256 | 220/266 |
| 6,772,902 | B1 * | 8/2004 | White | B65D 43/162 | 215/201 |
| 2008/0110911 | A1 * | 5/2008 | Chen | B65D 45/32 | 220/788 |
| 2011/0006066 | A1 * | 1/2011 | Vandamme | B65D 43/22 | 220/315 |
| 2014/0209604 | A1 * | 7/2014 | Leung | B65D 47/0828 | 220/263 |
| 2015/0315532 | A1 * | 11/2015 | Bergbohm | B65D 43/16 | 220/315 |
| 2016/0107806 | A1 * | 4/2016 | Fraser | A47G 19/2205 | 53/485 |
| 2018/0273258 | A1 * | 9/2018 | Luburic | B65D 43/163 | |

* cited by examiner

*Primary Examiner* — J. Gregory Pickett
*Assistant Examiner* — Niki M Eloshway
(74) *Attorney, Agent, or Firm* — Stephen J. Stark; Miller & Martin PLLC

(57) ABSTRACT

An improved lid and pail combination provides a child resistant connection for use with pails.

20 Claims, 7 Drawing Sheets

CHILD RESISTANT PAIL

CLAIM OF PRIORITY

This application claims the benefit of U.S. Provisional Patent Application No. 62/640,698 filed Mar. 9, 2018 which is incorporated herein by reference in its entirety.

FIELD OF THE INVENTION

The present invention relates to pails having child resistant openings and more particularly to pails having hingedly connected lids with child resistant locking mechanisms.

BACKGROUND OF THE INVENTION

Pails have been utilized in many industries as containers for products and/or other uses. The applicant has sold cylindrical shaped pails, rectangular shaped pails and other pail configurations over the years. D706,509 is a recent design patent for a rectangularly shaped pail having a hinged lid opening. U.S. Pat. No. 9,446,890 is another one of the applicant's patents relating to rectangular pails having safety features.

Nevertheless, the applicant's customers have requested the applicant provide a child safe hinged lid construction pail to the market. The applicant believes a need exists for an improved child resistant pail for various uses.

SUMMARY OF THE INVENTION

It is a present object of many embodiments of the present invention to provide an improved hinged lid pail having a child resistant locking feature whereby when the pail is shut relative to the container, the lock assembly is preferably child resistant.

It is another object of many embodiments of the present invention to provide an improved hinged lid/pail combination whereby when the lid is shut and locked, a sufficient degree of understanding (preferably by those over four years old) is desirable to open the lock.

It is another object of many embodiments to provide an improved child resistant locking mechanism for hinged lids on open-ended containers.

Accordingly, in accordance with a presently preferred embodiment of the present invention, an open-ended container such as a rectangular pail has a hinged lid which can selectively open or close over a top of the open pail and preferably lock in a locked position. Many parties provide non-child proof locking lids or such constructions. FIGS. 1A and B show how many prior art lids can be unlocked while FIGS. 2A, B, and C show how the process of locking a prior art lid of this construction. These lids normally have an angled ramp 4 which cooperates with a planar shelf 5. Specifically, a bottom planar surface 1 of the angled ramp normally rests on top of an upper surface 2 of the planar shelf of the lid once installed and locked. The upper surface 2 of the locking mechanism is usually pulled away with a tab 3 or by pulling up at a cantilevered end of the tab 3 which deflects the upper surface 2 of the locking mechanism sufficiently enough to disengage the bottom flat face (surface) of the ramp 4 to allow the lid to open.

As opposed to the prior art method, a new method of providing a locking mechanism for a pail is somewhat similar in that a first locking mechanism connected to the lid can cooperate with a second locking mechanism (either directly or indirectly connected to the pail) as it is shut so that the first locking mechanisms is capable of being pushed outwardly by a ramp to a sufficient degree to then engage.

However, a difference exists in that a stop extends above an upper surface of the locking mechanism (in the prior art a planar surface). If one were to attempt to grab the lip or tab and pull outwardly as is done in the prior art, the stop would engage a rear surface or receiver in an under-portion of the ramp to prevent one from being able to pull out as the prior art allows. Instead, a bottom surface of the lid can be provided with at least one resilient member which may contact an upper surface of the container (or a base of a lid assembly) (or visa versa) to resiliently bias the lid into locking the engagement with the pail when locked. In order to disengage the first and second locking mechanism, the lid is pushed down sufficiently to overcome the bias so as to provide a gap between the first and second locking mechanisms (which also disengages the stop from the receiver) at least a sufficient amount of distance so that then the lip can then be pulled and/or rotated so as during that action, with that the stop does not engage the receiver and the first and second locking mechanisms can now be disengaged.

It is an expectation that a child would not understand the concept of needing to push the lid down in order to pull the first locking mechanism away from the second locking mechanism to disengage the lock so as to then be able to open the lid relative to the pail, and thus the locking mechanism would be "child-resistant."

BRIEF DESCRIPTION OF THE DRAWINGS

The accompanying drawings illustrate the preferred embodiments of the invention and, together with the description, serve to explain the invention. These drawings are offered by way of illustration and not by way of limitation.

DETAILED DESCRIPTION OF THE PREFERRED EMBODIMENT

Figure 1A:
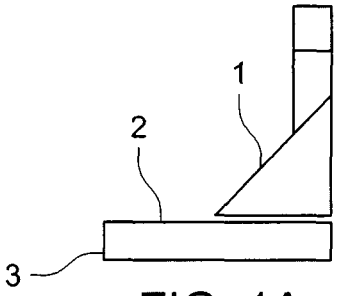
FIG. 1A (PRIOR ART)
FIGS. 1A and 1B are cross sectional views of a first and second locking mechanisms from the prior art transitioning from a locked to a disengaged configuration.
Figure 1B:
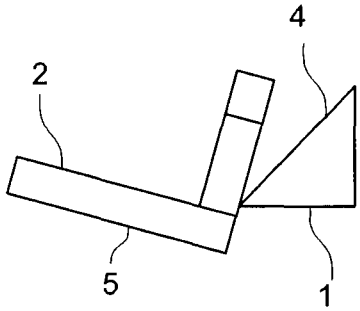
FIG. 1B (PRIOR ART)
Figure 2A:
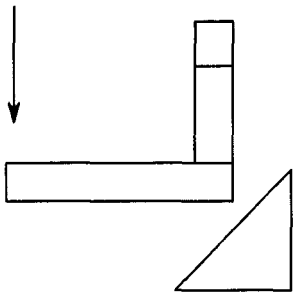
FIG. 2A (PRIOR ART)
FIGS. 2A-2C are cross sections of the first and second locking mechanisms of the prior art showing engagement of the first locking mechanism relative to a second locking mechanism to a locked configuration.
Figure 2B:
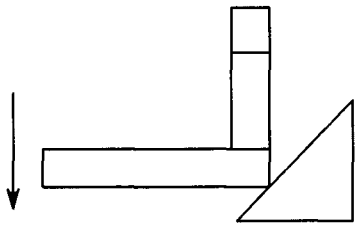
FIG. 2B (PRIOR ART)
Figure 2C:
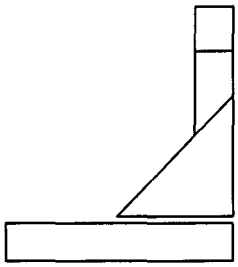
FIG. 2C (PRIOR ART)

FIG. 1 shows a prior art locking mechanism in FIGS. 1A-2C. This design has been discussed in the Background of the Invention section. This prior art locking mechanism is often utilized with prior art hinged lids connected to pails. This type prior art construction is not normally thought of as being child-resistant. When in locked configurations, the bottom surface of the lid is normally in contact with an upper surface of the pail. Further pushing of the pail lid against the upper surface of the pail should not move the first locking mechanism portion relative to the second locking mechanism portion when in the locked configuration. Furthermore, pushing upwardly on the cantilevered extending end of the lip of the locking mechanism is usually sufficient (and is designed to be so) to rotate the opposite end of the first locking mechanism out of engagement with the bottom surface of the ramp so as to then unlock the locking mechanism to then be able to open the lid.

While the prior art design works for its intended purpose of providing a locking pail construction, they are not normally child-resistant. Accordingly, a presently preferred embodiment of the present invention is directed at achieving that objective for many embodiments in the form of a container or pail 12 having a locking lid 16 with pail 12 hingedly connected by a hinge 14 to lid 16. The lid 16 may be part of a lid assembly having a base 18 that can be pressed onto the pail 12 as would be understood by those of ordinary skill in the art. Basically, the manufacturer could fill the pail 12 with a desired material and then push the base 18 onto the pail 12 as understood by those of ordinary skill in the art. Oftentimes the lid 16 would be shut relative to the base 14 when installing on a pail 12. The base 18 would then form an opening into a volume of the pail 12. Other pail 12/lid 16 constructions may not have a base 18 or have a different construction of a base 18.

With the lid 16 shut relative to the base 18 as provided by many manufacturers, there may be a tamper indicator 20 (at least for some embodiments) which might need to be removed relative to the base 18 in order to open the lid 16 relative to the pail 12. One particular style tamper indicator 20 illustrated has grip 22 which can then pull away strip 24 which may have a plurality of bores 26,28,30 which receive feet 32,34,36 therein to prevent opening of the lid 16 relative to the base 18. With the strip 24 removed, and the feet 32-36 are disengaged from the bores 26-30. With the locking mechanism disengaged, the lid 16 can then pivot about hinge 14 to open as would be understood by those or ordinary skill in the art. Of course, other tamper indicators of various types could be utilized in other embodiments, if at all. The opposite side may have a similar or dissimilar tamper indicator or a single tamper indicator of various constructions could be utilized for various embodiments as well.

Figure 4:
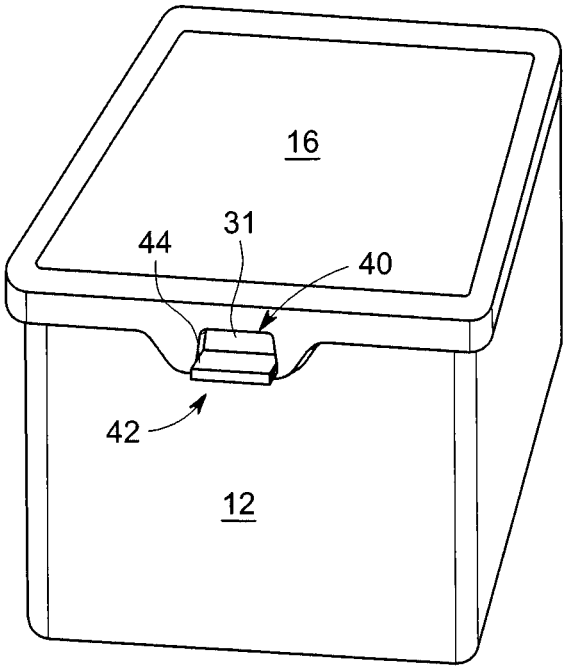
FIG. 4 shows a front perspective view of the container and lid combination of FIG. 3 in a closed and locked configuration.
Figure 5:
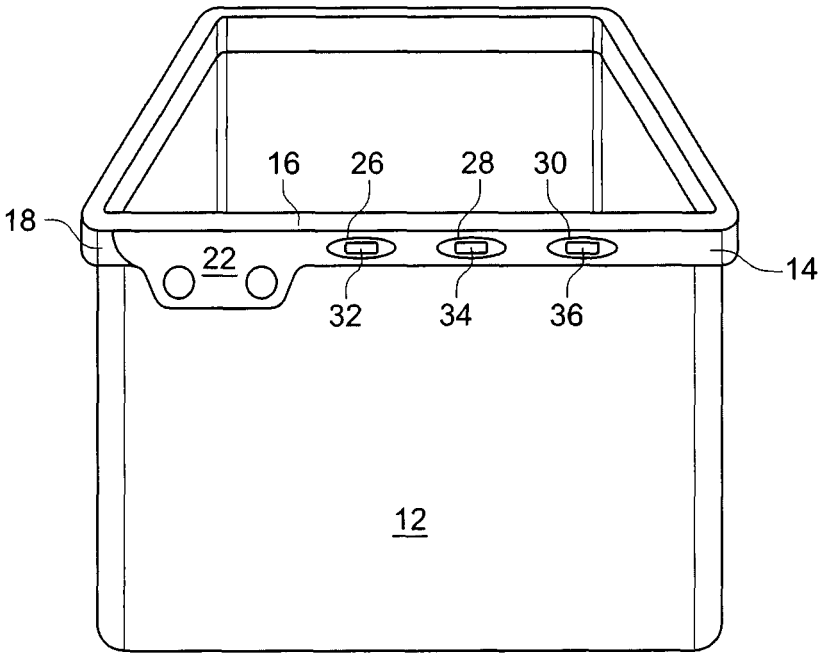
FIG. 5 shows a side view showing an optional tamper resistant mechanism of many embodiments.
Figure 17:
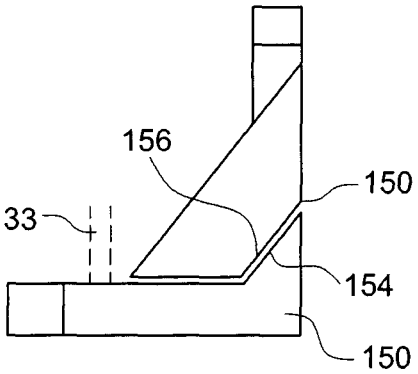

FIG. 4 shows the lid 16 shut relative to the base 18. The base 18 is connected to the container 12. The locking mechanism 40 has first locking mechanism portion 42 retained by second locking mechanism portion 44 in the illustrated embodiment. Different locking mechanisms 42,44 can be utilized other than those illustrated. Specifically, the illustrated embodiments have a window 31 above the tab 53 for many embodiments. Other embodiments may have a shoulder 33 supporting the tab 53 (such as downwardly depending from lid 16 with the tab 53 extending beyond the shoulder 33 as seen in FIG. 17). Still other embodiments may have other constructions.

Figure 6:
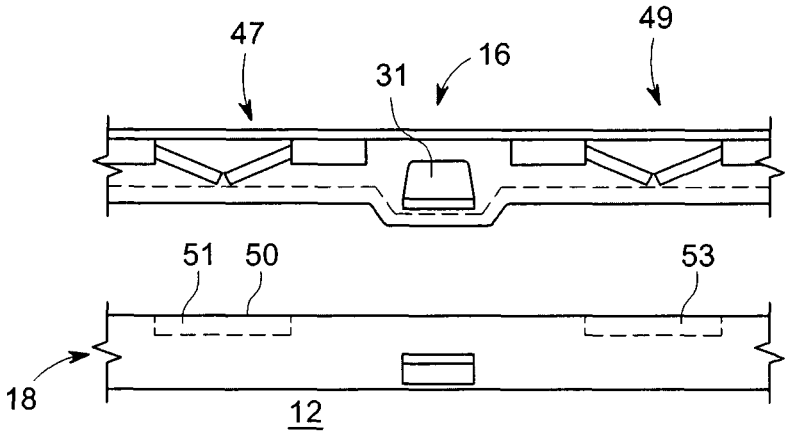
FIG. 6 shows a partial cut away view showing a portion of the pail of FIGS. 3-4 in an open configuration showing internal resilient members connected to the lid.
Figure 7:
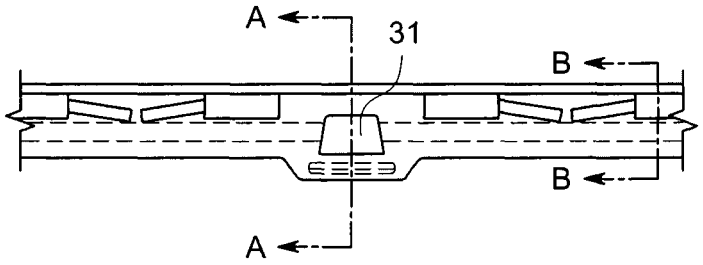
FIG. 7 shows a similar view as FIG. 6 showing a shut and locked configuration; with the resilient members less deflected than in FIG. 5.
Figure 8:
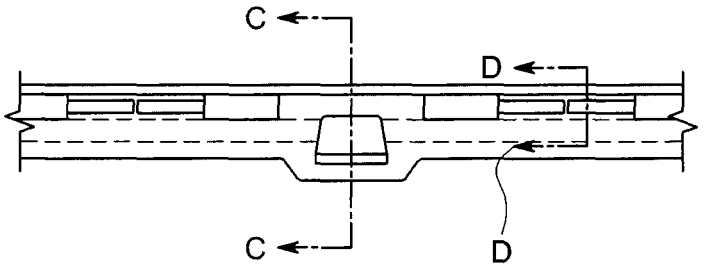
FIG. 8 shows a similar view as FIGS. 6 and 7 with the resilient members in a more deflected state thereby allowing separation of a first locking mechanism portion relative to a second locking mechanism portion.
Figure 9:
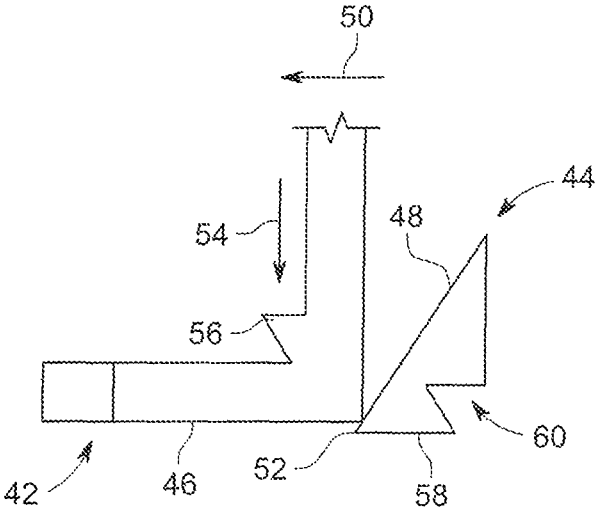
FIG. 9 shows a partial cross sectional view showing a process of locking the first locking mechanism relative to the second locking mechanism of the present preferred embodiment.

FIG. 6 shows a partial cutaway view of the embodiment of what is shown in FIG. 4 which shows resilient members 47,49 which in this figure, do not contact an upper surface 50 of the base 18 or container 12 depending on how the embodiment is constructed. The lid 16 can then be shut relative to the base 28 and/or pail 12 so that first locking portion 42 can cooperate with a second locking member portion 44 normally by having a bottom surface 46 of the first locking mechanism portion 42 contact an upper ramp surface 48 of the second locking mechanism portion 44 to then push the first locking mechanism portion 42 away (forwardly) illustrated by arrow 50 until it clears the end 52 of the ramp surface 48 as it proceeds downwardly in direction 54. Then a window 51 having a tab 53 with a stop 56 allows the stop 56 to proceed under lower surface 58 of the second locking mechanism portion 44 until it engages receiver 60 wherein the stop 56 has a front facing surface 62 which cooperates with a rear surface 64 shown in FIG. 10 to initially prevent the rotation illustrated by arrow 66 (the prior art mechanism would normally open utilizing such a movement).

Figure 11:
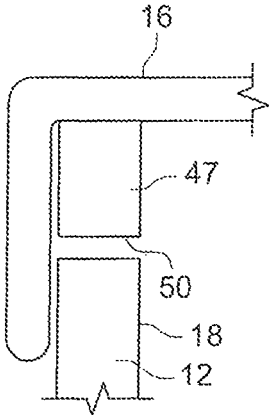
FIG. 11 shows a cross sectional view taken across the line B-B of FIG. 7.
Figure 12:
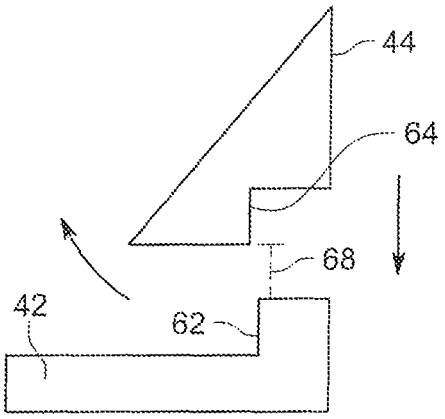
FIG. 12 shows a cross sectional view taken along the line C-C of FIG. 8.

As can be seen by FIG. 11, resilient member 47 which may be similar to 49 for the illustrated embodiment, but need not be so with other embodiments, is shown contacting upper surface 50 whether that be of the base 18 and/or container 12 depending on the construction of the base 18 and container 12. There could be cutouts 51,53 through the base 18 which permit the resilient members 47,49 to contact the container 12 directly or other mechanisms could be provided as would be understood by those of ordinary skill in the art so that upper surface 50 could contact to either of the base 18 or the container 12. Upper surface 50 need not necessarily be uppermost surface, but could be for various embodiments. Resilient member(s) 47,49 could connect to base 18 or container 12 for other embodiments (possibly at other locations as well).

Figure 10:
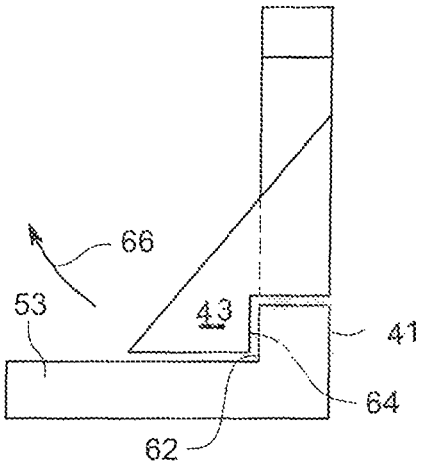
FIG. 10 shows a partial cross sectional view taken along the line A-A of FIG. 7.

FIGS. 10 and 11 show the locked configuration of the locking mechanism 40. This construction is believed to be childproof.

Figure 13:
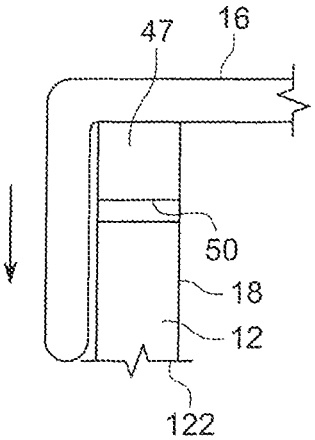
FIG. 13 shows a cross sectional view taken along the line D-D of FIG. 8.

In order to disengage the first locking portion 42 relative to the second locking portion 44 the lid 16 is pushed down relative to base 18 and/or container 12 as would be understood by those or ordinary skill in the art so as to provide a gap 68 separating first stay 41 from second stay 43 since the resilient members 47,49 are resilient they can compress as shown in FIG. 13 (from a less compressed to a more compressed state) which thereby provides a gap 68 which permits the first locking mechanism portion 42 to be rotated relative to 44 as the second locking mechanism portion in a somewhat similar manner as traditional locking mechanisms with the first and second stays 41, 43 separated (and stop 64 disengaged from the rear surface or face 62). Specifically, the front face 64 is moved out of engagement with the rear face 66 (or at least moved enough) to thus permit the unlocking.

As can be seen with reference to FIGS. 14-17, various constructions of the stop relative to the receiver can be constructed so as to provide a child resistant pail with locking lid with lid combination that is acceptable to consumers and provides the desired child resistant capability. Differences in these embodiments are discussed below.

Figure 14:
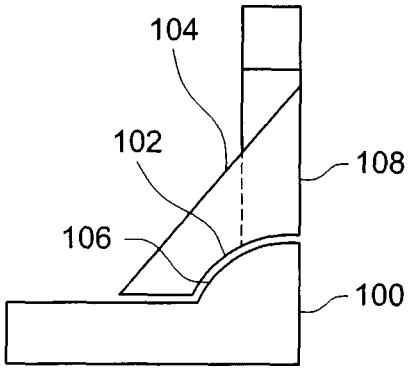
FIGS. 14-17 show cross sectional views of the first and second locking mechanisms of alternatively preferred embodiments as would be understood by those of ordinary skill in the art.

FIG. 14 shows a bead style construction for a stop 100 received in a receiver 102 of a ramp 104. This stop 100 has a concave exterior surface 106 which is received within a concave surface 108 or other shaped surface of the receiver 102.

Figure 15:
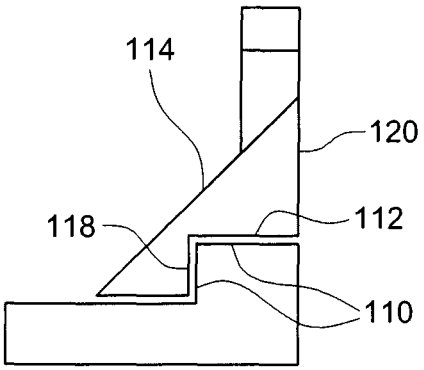

FIG. 15 has a block style construction for stop 110 received in a receiver 112 of a ramp 114. The front face 116 is substantially perpendicular to plate 118 and contacts a rearward facing wall 120 which could be along an inner face 122 of the base 18 or offset therefrom as shown. Other constructions for stop 110 could cooperate with an inner face 122 of the base 18 for other embodiments as well.

Figure 16:
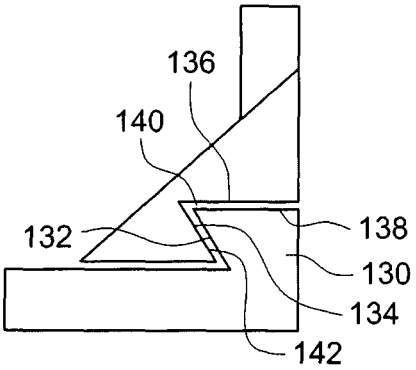

FIG. 16 shows as resistive stop 130 which has a front face 132 which is received in receiver 134 having a portion of the receiver (136) below an upper portion 138 of the stop 130 located rearwardly relative a front portion 140 of the stop 130. This can be accomplished with the ramp face 142 or otherwise for other embodiments.

FIG. 17 shows a cooperating stop 150 which has an angle less than perpendicular which may assist in placing the lid 16 into a locked configuration by sliding into position as the stop face 154 contacts receiver face 156 which may assist in defining receiver 158 or otherwise.

Resilient members 47 and/or 49 can take various forms. They are illustrated having feet 80,82 which extend downwardly toward base 18 and/or pail 12 until contacting a surface at which time at least one can deflect upwardly, under at least some resiliency toward its normal downwardly extending position. Feet 80,82 may, or may not, deflect to a flat configuration as illustrated in a more deflected position shown in FIG. 13 than a less deflected position shown in FIG. 11. At least one resilient member 47 or 49 provides bias which needs to at least partially be overcome to provide gap 68 to then be able to open the first locking mechanism portion 42 relative to the second locking mechanism portion 44.

Figure 18:
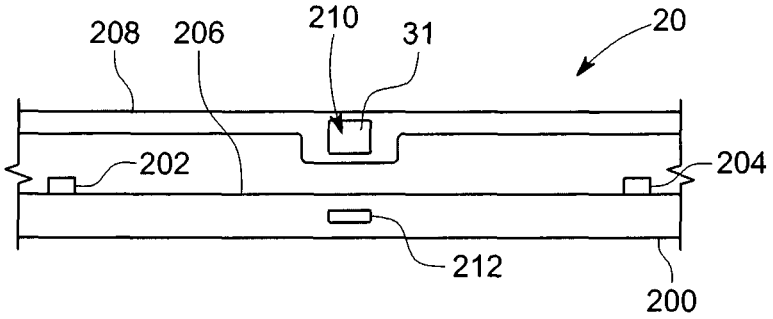
FIGS. 18-20 show a front perspective view of an alternatively preferred embodiment similar to that of FIGS. 6-8 and 11-12 for a first and second locking mechanism.
Figure 19:
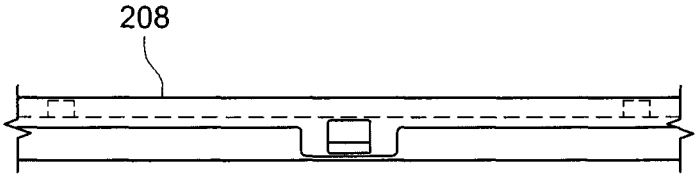

FIG. 18 shows a first alternatively preferred embodiment for a pail 200 that has stops 202,204 either connected to an upper end 206 of the pail 200 or located on the lid 208 so that as the lid 208 is shut on the pail 200, the stops 202,204 may initially assist in maintaining the resistive stop 210 in locking engagement with the receiver 212.

Figure 3:
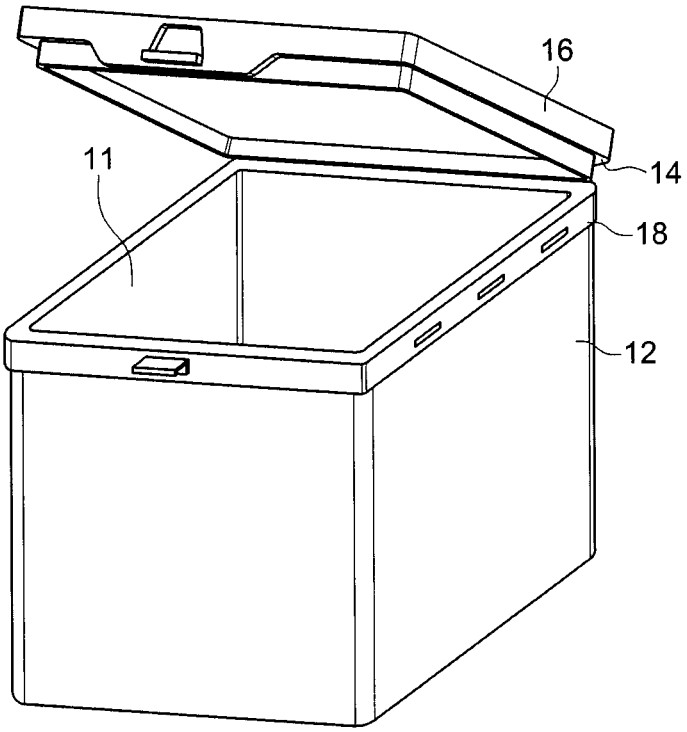
FIG. 3 is a perspective view of a presently preferred embodiment of the present invention showing a lid assembly connected to a container or pail in an open configuration.
Figure 20:
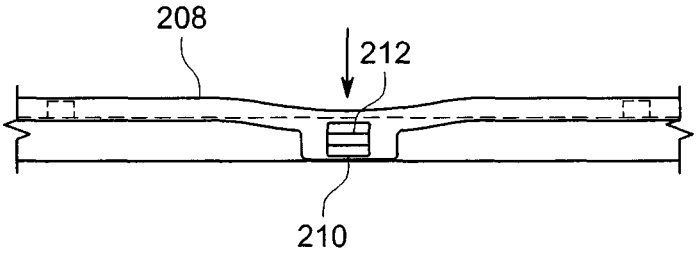

The resistive stop 210 can be pushed downwardly so that lid 208 flexes downwardly as shown in FIG. 20 intermediate the stops 202,204 to disengage the resistive stop 210 from the receiver 212. Thus the lid 208 for such an embodiment can act as a resilient member as it flexes between the stops 202, 204 which can be molded extensions connected to at least one of an area near the upper end 206 of the pail 200 as illustrated or downwardly extending from a surface of the lid 208. The stops 202, 204 are shown near corners 220,222 of pail 12 in FIG. 3, but could be located in other locations in other embodiments.

The feet 80,82 can connect to mount 84 which may be received in one or more receivers of the lid 12. Other resilient members may connect to the lid 16 in various ways preferably towards a front of the lid 16, base 18 and/or pail 12 opposite to the hinge 14 (at a rear of the lid 16). Some embodiments may connect resilient member(s) to the pail 12 or base 18.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed herein is:

1. A pail lid combination comprising:

a pail having upwardly extending side walls terminating at an open upper end;

a lid hingedly connected relative to the pail at the upper end of the pail;

a locking mechanism having first and second locking mechanism portions, the first locking mechanism portion connected to the lid with a cantileveredly outwardly extending tab, and the second locking mechanism portion connected to the pail, wherein when in a locked configuration the tab extends outwardly away from the pail and the first and second locking mechanism portions cooperate to initially prevent the lid from rotating upwardly away from the pail with first and second stays contacting one another, and the first locking portion has a stop upwardly extending therefrom the first stay, the stop located above the tab, said stop cooperating with a rear surface of a receiver of the second portion which prevents outward movement of the first locking portion relative to the second locking portion unless the first locking portion is first downwardly displaced relative to the second locking portion using the tab a predetermined downward distance to disengage the stop and the first stay from the receiver to a disengaged configuration which then permits the lid to be rotated upwardly away from the pail when so directed to an open configuration; and wherein said first locking mechanism portion has a vertically extending opening above the first stay through which the second stay of the second locking mechanism portion laterally extends in the locked configuration.

2. The pail and lid combination of claim 1 wherein the lid is a portion of a lid assembly having a base with the lid hingedly connected to the base and the base connected to the upper end of the pail.

3. The pail and lid combination of claim 2 wherein the lid assembly further comprises a tamper indicator.

4. The pail and lid combination of claim 3 further comprising a strip initially connected to the lid and having bores therethrough, said bores receiving feet connected to the base and initially extending through the bores to show an untampered condition, and the strip must be removed to allow the lid to be moved to the open configuration.

5. The pail and lid combination of claim 2 having at least one resilient member upwardly biasing the lid relative to the base in the locked configuration.

6. The pail and lid combination of claim 5 wherein the at least one resilient member is located against the upper end of the pail.

7. The pail and lid combination of claim 6 wherein the pail has a side with the locking mechanism and the at least one resilient member is located along the side.

8. The pail and lid combination of claim 2 wherein the first stay has a planar portion and the stop extends perpendicularly above the planar portion of the first stay.

9. The pail and lid combination of claim 2 wherein the stop extends away from the base it proceeds upwardly above the first locking mechanism.

10. The pail and lid combination of claim 9 wherein an exterior face of the stop is one of curved and angled.

11. The pail and lid combination of claim 2 wherein the stop has an exterior surface which is received against a corresponding exterior surface of the receiver.

12. The pail and lid combination of claim 2 wherein the second locking portion is formed into the base.

13. The pail and lid combination of claim 2 having at least one resilient member upwardly biasing the lid relative to the base in the locked configuration.

14. The paid and lid combination of claim 13 further comprising spaced apart resilient members spaced on opposite sides of the locking mechanism.

15. The pail and lid combination of claim 14 wherein the resilient members downward extend from the lid to contact the base.

16. The pail and lid combination of claim 1 where in the first locking portion is formed into the lid.

17. The pail and lid combination of claim 1 wherein the first locking portion further comprises a window through which the second locking portion extends through in the locked configuration.

18. The pail and lid combination of claim 1 having at least one resilient member upwardly biasing the lid relative to the base in the locked configuration.

19. The pail and lid combination of claim 18 wherein the at least one resilient member is located against the upper end of the pail.

20. A pail and lid combination comprising:

a pail having upwardly extending side walls terminating at an open upper end;

a lid hingedly connected relative to the pail at the upper end of the pail, wherein the lid is a portion of a lid assembly having a base with the lid hingedly connected to the base and the base connected to the upper end of the pail;

a locking mechanism having first and second locking mechanism portions, the first locking mechanism portion connected to the lid with a cantileveredly outwardly extending tab, and the second locking mechanism portion connected to the pail, wherein when in a locked configuration the tab extends outwardly away from the pail and the first and second locking mechanism portions cooperate to initially prevent the lid from rotating upwardly away from the pail with first and second stays contacting one another, and the first locking portion has a stop upwardly extending therefrom the first stay, the stop located above the tab, said stop cooperating with a rear surface of a receiver of the second portion which prevents outward movement of the first locking portion relative to the second locking portion unless the first locking portion is first downwardly displaced relative to the second locking portion using the tab a predetermined downward distance to disengage the stop and the first stay from the receiver to a disengaged configuration which then permits the lid to be rotated upwardly away from the pail when so directed to an open configuration; and wherein the stop extends rearwardly toward the base it proceeds upwardly above the first locking mechanism above the first stay, and said first locking mechanism portion has an opening above the first stay through which the second stay of the second locking mechanism portion extends in the locked configuration.

* * * * *